US007611224B2

(12) United States Patent
Tsuyama

(10) Patent No.: US 7,611,224 B2
(45) Date of Patent: Nov. 3, 2009

(54) CONNECTION UNIT FOR CONNECTING AND HOLDING BELT AND CARRIAGE, RECORDING APPARATUS AND LIQUID EJECTING APPARATUS

(75) Inventor: Kazuhiko Tsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 411 days.

(21) Appl. No.: 11/393,280

(22) Filed: Mar. 29, 2006

(65) Prior Publication Data

US 2006/0238566 A1 Oct. 26, 2006

(30) Foreign Application Priority Data

Mar. 29, 2005 (JP) ..... P2005-096321

(51) Int. Cl.
*B41J 23/00* (2006.01)

(52) U.S. Cl. ..... 347/37

(58) Field of Classification Search ..... 347/37
See application file for complete search history.

(56) References Cited

U.S. PATENT DOCUMENTS 5,611,632 A * 3/1997 Hiramatsu et al. ..... 400/335
2004/0155923 A1* 8/2004 Ikeda et al. ..... 347/37

FOREIGN PATENT DOCUMENTS

JP 10-035051 2/1998
JP 2001-71463 3/2001
JP 2004-181682 7/2004

* cited by examiner

*Primary Examiner*—Julian D Huffman
*Assistant Examiner*—Jason S Uhlenhake
(74) *Attorney, Agent, or Firm*—Nutter McClennen & Fish LLP; John J. Penny, Jr.

(57) ABSTRACT

A connection unit connects and holds an endless belt which is wound between a drive pulley and a driven pulley, and a carriage on which a recording head is mounted and which is reciprocated in a main scanning direction. A holder is formed on the carriage. An elastic connector is held by the holder, and is operable to be connected to the belt. The connector includes a first absorber and a second absorber that hold the belt therebetween. The first absorber is longer than the second absorber in the main scanning direction.

8 Claims, 7 Drawing Sheets

CONNECTION UNIT FOR CONNECTING AND HOLDING BELT AND CARRIAGE, RECORDING APPARATUS AND LIQUID EJECTING APPARATUS

BACKGROUND OF THE INVENTION

The present invention relates to a connection unit for connecting and holding a carriage carrying belt in a shape of an endless strip wound between a drive pulley and a driven pulley, and a carriage reciprocated in a main scanning direction in a state of being attached with a recording head, a recording apparatus having the connection unit, and a liquid ejecting apparatus having the connection unit.

Here, a liquid ejecting apparatus is meant to include not only a recording apparatus of an ink jet type recording apparatus, a copier, a facsimile or the like for ejecting ink from a recording head as a liquid ejecting head to a recorded member of a record sheet or the like to record on the recorded member but also an apparatus of ejecting a liquid in correspondence with a specific use in place of ink from a liquid ejecting head in correspondence with the recording head to an ejected member in correspondence with the recorded member to adhere the liquid onto the ejected member. Further, as the liquid ejecting head, other than the above-described recording head, there are exemplified a colorant ejecting head used for fabricating a color filter of a liquid crystal display or the like, an electrode member (conductive paste) ejecting head used for forming an electrode of an organic EL display, a face light emitting display (FED) or the like, a living body organism ejecting head used for fabricating a biochip, and a sample ejecting head for ejecting a sample as a precision pipette or the like.

There is an ink jet printer as an example of an ink jet type recording apparatus or a liquid ejecting apparatus. An ink jet printer includes an ink jet recording head at a carriage thereof and the carriage is driven to reciprocate in a main scanning direction by a carriage motor and a belt for transmitting driving of the carriage motor while being guided by guide means (for example, guide shaft extended in the main scanning direction).

However, when a rapid speed change is brought about in driving the carriage motor, that is, when the carriage is abruptly stopped or abruptly started, a tension of the belt is rapidly changed. Therefore, in accordance with a change in the tension of the belt, vibration is brought about at the belt. Further, vibration of the belt has an influence on moving and positioning the carriage to have an influence also on recording on a recorded member.

Hence, in a related art, as in JP-A-2001-071463, there is a connection unit for preventing vibration in a main scanning direction propagated from a vibration source of a motor or the like by a belt from being propagated to a carriage by providing a projection of an elastic member on a side of the belt and fitting the projection to a connector on a side of the carriage.

However, there are a transverse wave and a longitudinal wave in a physical wave. The transverse wave is a wave in which an advancing direction and a vibrating direction of the wave are orthogonal to each other and vibration of a chord and an electromagnetic wave are examples thereof. The longitudinal wave is a wave in which an advancing direction and a vibrating direction of the wave are in parallel with each other and a sound wave is the wave. It is determined whether a longitudinal wave can be propagated or a transverse wave can be propagated according to the kind of a medium. Both of a longitudinal wave and a transverse wave are present in an elastic wave constituting a medium thereof by an elastic member (sound wave in a broad sense).

Further, in the related connection unit, reliability of absorbing vibration is not sufficient. In order to execute further excellent recording, it is necessary to prevent not only vibration of the longitudinal wave but vibration of the transverse wave from being propagated to the carriage.

SUMMARY

It is therefore an object of the invention to provide a connection unit for preventing vibration of a transverse wave and vibration of a longitudinal wave propagated from a vibration source of a motor or the like by a belt from being propagated to a carriage.

In order to achieve the object, according to the invention, there is provided a connection unit for connecting and holding an endless belt which is wound between a drive pulley and a driven pulley, and a carriage on which a recording head is mounted and which is reciprocated in a main scanning direction, the connection unit comprising:

a holder, formed on the carriage; and an elastic connector, held by the holder, and operable to be connected to the belt, the connector comprising a first absorber and a second absorber that hold the belt therebetween, wherein the first absorber is longer than the second absorber in the main scanning direction.

With this configuration, the first absorber includes a portion extruded from a position thereof being opposed to the second absorber. The extruded portion does not squeeze the belt in cooperation with the second absorber. That is, the extruded portion is not compressed and is sufficiently provided with an elastic force. As a result, the extruded portion is brought into contact with the belt and therefore, can absorb a transverse wave vibration and a longitudinal wave vibration of the belt.

A center portion of the first absorber may correspond to a center portion of the second absorber in the main scanning direction.

In this case, the first absorber includes the extruded portions on both sides of the first absorber in the main scanning direction. That is, to whichever side in the main scanning direction the carriage may move, the extruded portions can absorb a transverse wave vibration and a longitudinal wave vibration of the belt.

The second absorber may abut against an inner surface of the belt.

In this case, the second absorber which is shorter than the first absorber in the main scanning direction is arranged on an inner periphery of the belt. Therefore, there is not a concern of being brought into contact with the drive pulley and the driven pulley by an amount of being short in the main scanning direction. That is, a main scanning distance of the carriage can be set to be longer by the amount of being short in the main scanning direction.

The connector may further include a third absorber, integrally formed with the first absorber, projected from the holder in the main scanning direction, and abutting against the belt.

In this case, the third absorber is projected from the holder and therefore, is not compressed and is sufficiently provided with the elastic force. Therefore, the third absorber is brought into contact with the belt and therefore, can further effectively absorb the transverse wave vibration and the longitudinal wave vibration of the belt.

Further, the third absorber can exert a force to the belt from the holder in the main scanning direction to push or pull the belt. The former force can be canceled by the longitudinal wave pushing the carriage (approaching wave) at the position of the belt brought into contact with the third absorber. On the other hand, the latter force can be canceled by the longitudinal wave pulling the carriage (leaving wave).

the first absorber and the second absorber may be integrally formed in a horseshoe shape in the main scanning direction.

In this case, a simple structure can be constituted by reducing a number of pieces of parts.

The connector may include a projection being engageable with the holder.

In this case, a positional shift of the connector relative to the holder can be prevented.

In order to achieve the object, according to the invention, there is also provided a recording apparatus comprising:

an endless belt, wound between a drive pulley and a driven pulley;

a carriage, operable to be reciprocated in a main scanning direction;

a recording head, mounted on the carriage, and operable to record information on a medium; and the connection unit for connecting and holding the belt and the carriage, the connection unit comprising:

a holder, formed on the carriage; and an elastic connector, held by the holder, and operable to be connected to the belt, the connector comprising a first absorber and a second absorber that hold the belt therebetween, wherein the first absorber is longer than the second absorber in the main scanning direction.

In order to achieve the object, according to the invention, there is also provided a liquid ejecting apparatus comprising:

an endless belt, wound between a drive pulley and a driven pulley;

a carriage, operable to be reciprocated in a main scanning direction;

a recording head, mounted on the carriage, and eject liquid toward a medium; and a connection unit for connecting and holding the belt and the carriage, the connection unit comprising:

a holder, formed on the carriage; and an elastic connector, held by the holder, and operable to be connected to the belt, the connector comprising a first absorber and a second absorber that hold the belt therebetween, wherein the first absorber is longer than the second absorber in the main scanning direction.

DETAIL DESCRIPTION OF PREFERRED EMBODIMENTS

An embodiment of the invention will be explained in reference to the drawings as follows.

Figure 1:
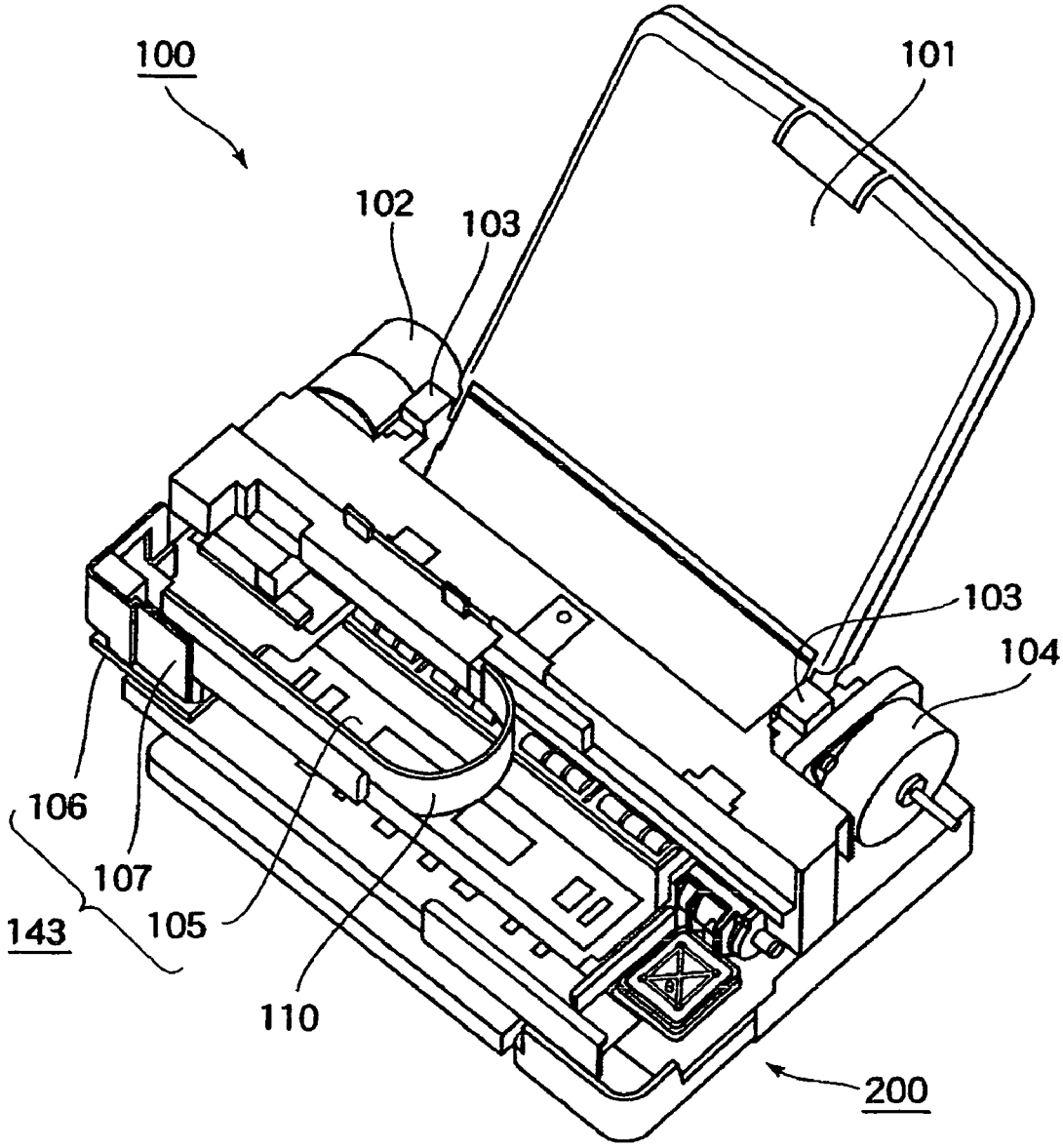
FIG. 1 is a total perspective view showing an outline of a recording apparatus according to the invention.

FIG. 1 shows a total perspective view showing an outline of a recording apparatus according to the invention. Further, FIG. 2 shows a total plane view showing the outline of the recording apparatus according to the invention.

A rear face side of a main body of a recording apparatus 100 is attachably and detachably provided with a sheet cassette 101 laminated with a sheet as a recoded member. The sheet laminated at a topmost position of the sheet cassette 101 is picked up by a feeding roller (not illustrated) driven by a feeding motor 104 and is fed to a carrying roller (not illustrated) on a downstream side in a carrying direction while being guided by a sheet guide 103. The sheet fed to the carrying roller is carried to a recording unit 143 further on the downstream side in the carrying direction by a carrying roller driven by a carrying motor (not illustrated). The recording unit 143 is constituted by a platen 105 for supporting the sheet from a lower side, and a carriage 107 provided to be opposed to an upper side of the platen 105. The carriage 107 therein is driven by a carriage motor 102 while being guided by a carriage guide shaft 153 extended in a main scanning direction.

Figure 2:
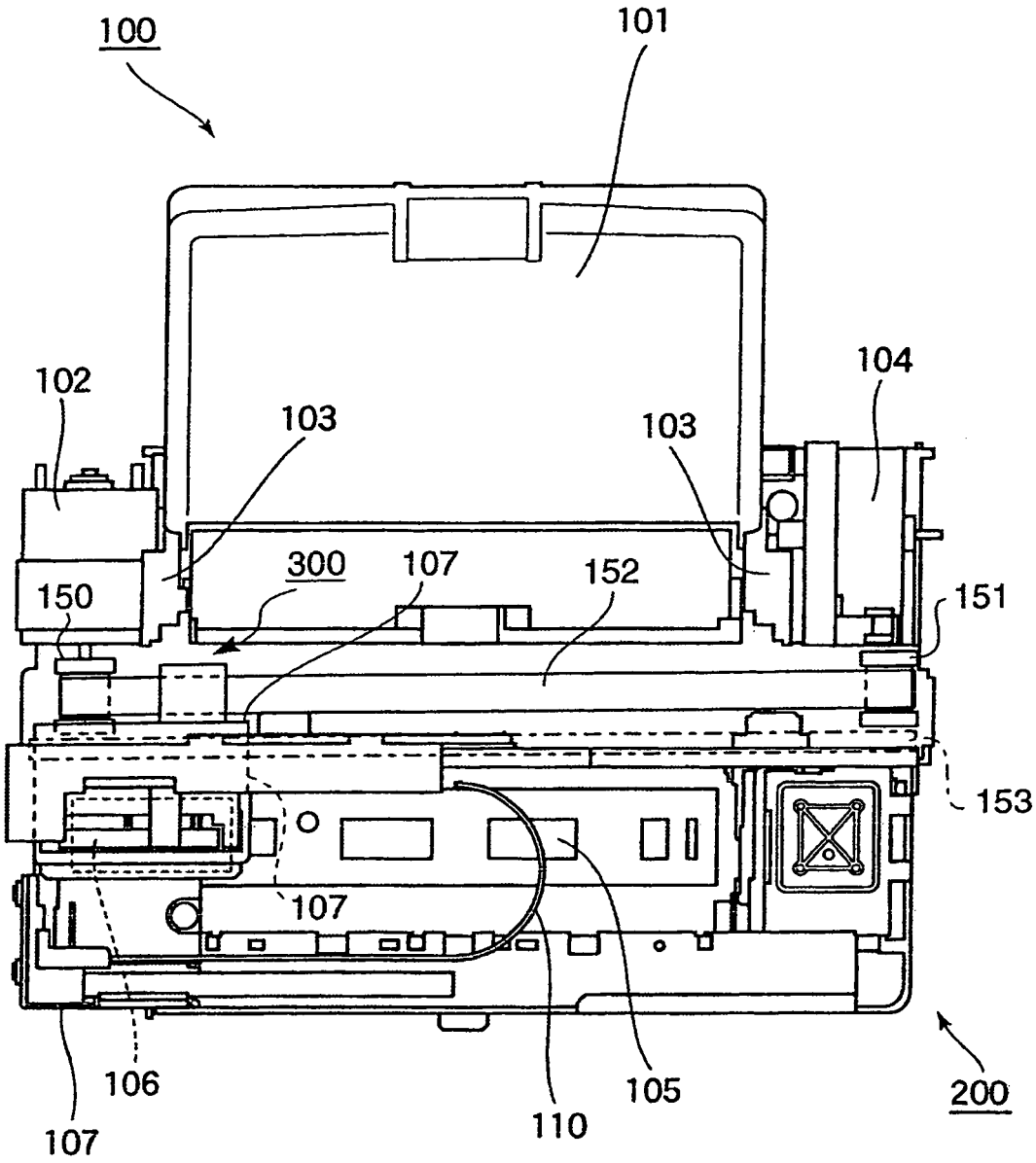
FIG. 2 is a total plane view showing the outline of the recording apparatus according to the invention.

Specifically, a carriage carrying belt 152 in a shape of an endless strip is wound between a drive pulley 150 provided on a 80 column side constituting a left side of FIG. 2 and driven by the carriage motor 102 and a driven pulley 151 provided on a 1 column side constituting a right side of FIG. 2. Further, a connecting and holding mechanism provided on a side of the carriage is connected with the carriage carrying belt 152. Therefore, the carriage 107 can be moved in the main scanning direction by being driven by the carriage motor 102. Further, a bottom face portion of the carriage 107 is provided with a recording head 106 for ejecting ink to the sheet. The sheet recorded by the recording unit 143 is carried further to the downstream side and is discharged from a front face side of the recording apparatus 100 by a sheet discharge roller (not illustrated).

Further, the lower side of the main body of the recording apparatus 100 is charged with an ink cartridge (not illustrated) and ink is supplied to an ink supply path (not illustrated) by way of an ink supply needle (not illustrated). Further, ink is supplied to the recording head 106 of the carriage 107 by way of an ink supply tube 110. Further, in flushing and in cleaning the recording head 106, an operation of ejecting/sucking ink is carried out at an ink sucking device 200 provided on the 1 column side.

Figure 3:
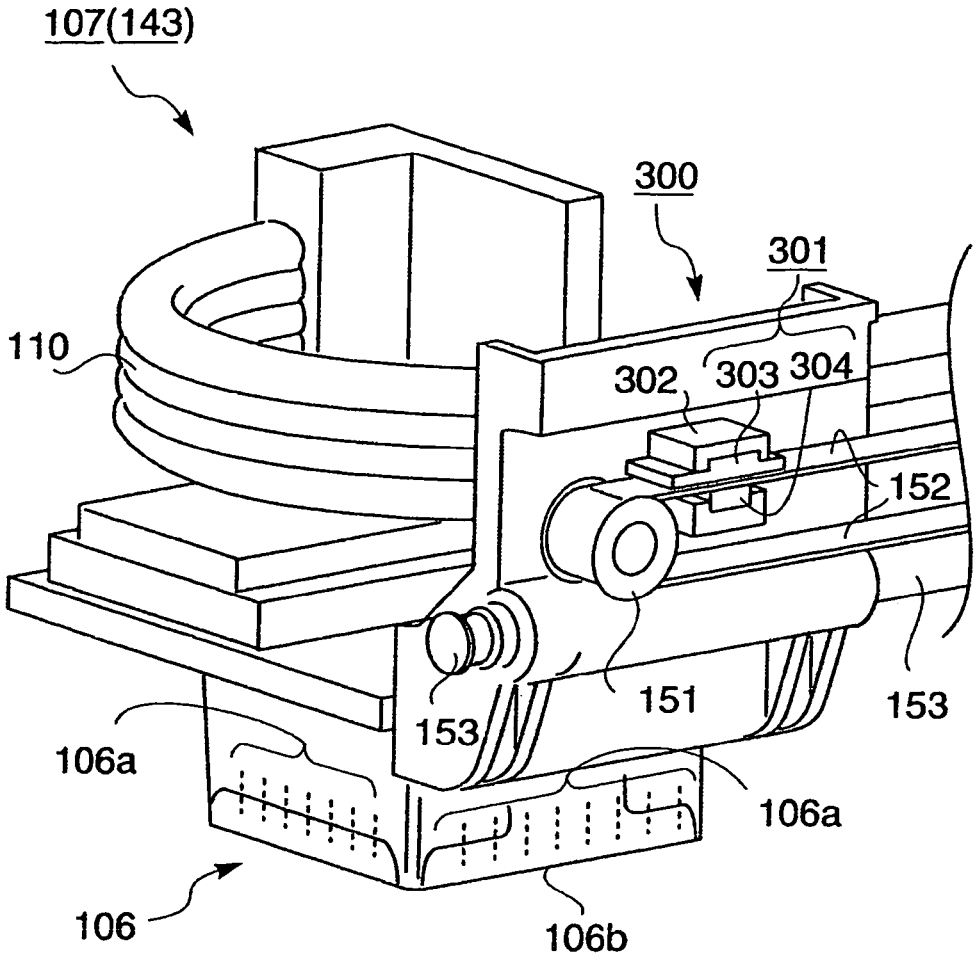
FIG. 3 is a perspective view of a carriage according to the invention and a periphery thereof viewed from a rear face side.

FIG. 3 shows a perspective view of the carriage according to the invention and a periphery thereof viewed from a rear face side.

As shown by FIG. 3, a lower side of the carriage 107 is provided with the recording head 106, and the recording head 106 includes a nozzle opening row 106*a* formed by nozzle openings for ejecting ink at a nozzle opening forming face 106*b* at a lower face thereof. Further, the carriage guide shaft 153 is provided to guide the carriage 107 in the main scanning direction by being inserted to a part of the carriage 107. Further, a connection unit 300 is provided on a side of the carriage, and the connection unit 300 is constituted by a connector 301 for connecting with the carriage carrying belt 152 and a holder 302 for holding the connector 301. The connector 301 is provided with a first absorber 303 and a second absorber 304, which will be explained as follows.

Figure 4A:
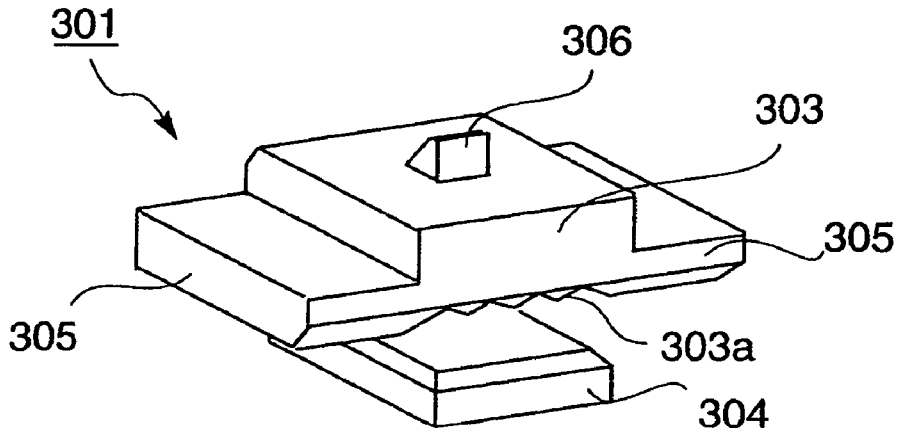
FIGS. 4A to 4C are a perspective view, a rear view and a side view of a connector according to the invention.
Figure 4B:
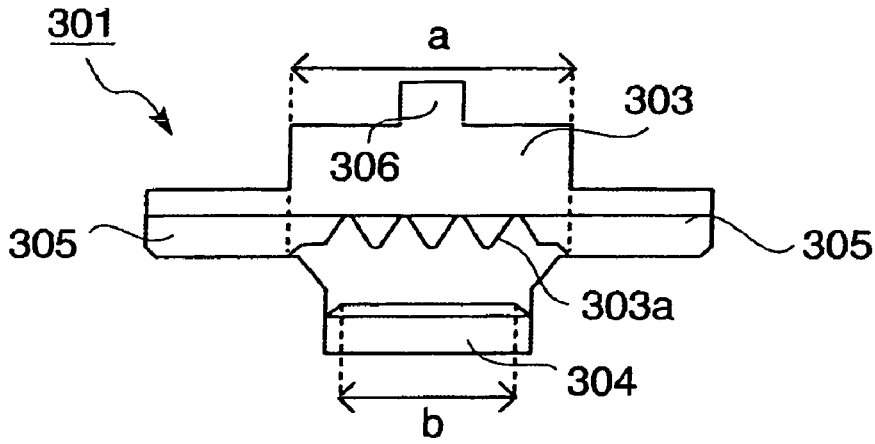
Figure 4C:
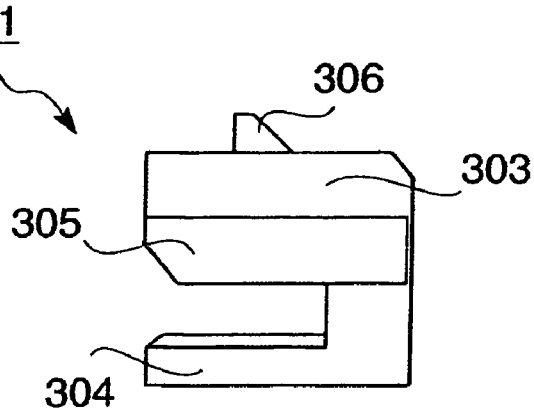

FIGS. 4A to 4C show a connector according to the invention, FIG. 4A is a perspective view viewed from a rear face side of the connector, FIG. 4B is a rear view, and FIG. 4C is a side view.

As shown by FIGS. 4A and 4B, an upper side of the connector 301 is provided with the first absorber 303 and the second absorber 304 is provided at a position opposed to the first absorber 303 on a lower side thereof. Here, when a length in the main scanning direction of a contact face of the first absorber 303 is designated by notation a, and a length in the main scanning direction of a contact face of the second absorber 304 is designated by notation b, the first absorber 303 and the second absorber 304 are provided to establish a relationship shown below.

Length a of the first absorber 303>Length b of the second absorber 304

Further, third absorbers 305 are provided to project from the holder on both sides in the main scanning direction of the first absorber 303. Further, an upper side of the first absorber 303 is provided with a drawout stopping projection 306 engaged with the holder 302. Furthermore, a face of the first absorber 303 opposed to the second absorber 304 is formed with a first teeth portion 303*a* engaged with a second teeth portion 152*a* (refer to FIGS. 5A and 5B) provided at the carriage carrying belt 152. Further, the connector 301 is constituted to be symmetrical in a left and right direction, that is, to be aligned to a center thereof. Further, as shown by FIG. 4C, the connector 301 is constituted by a horseshoe shape (U-shape) in a side view thereof and the first absorber 303 and the second absorber 304 are integrally formed.

Figure 5A:
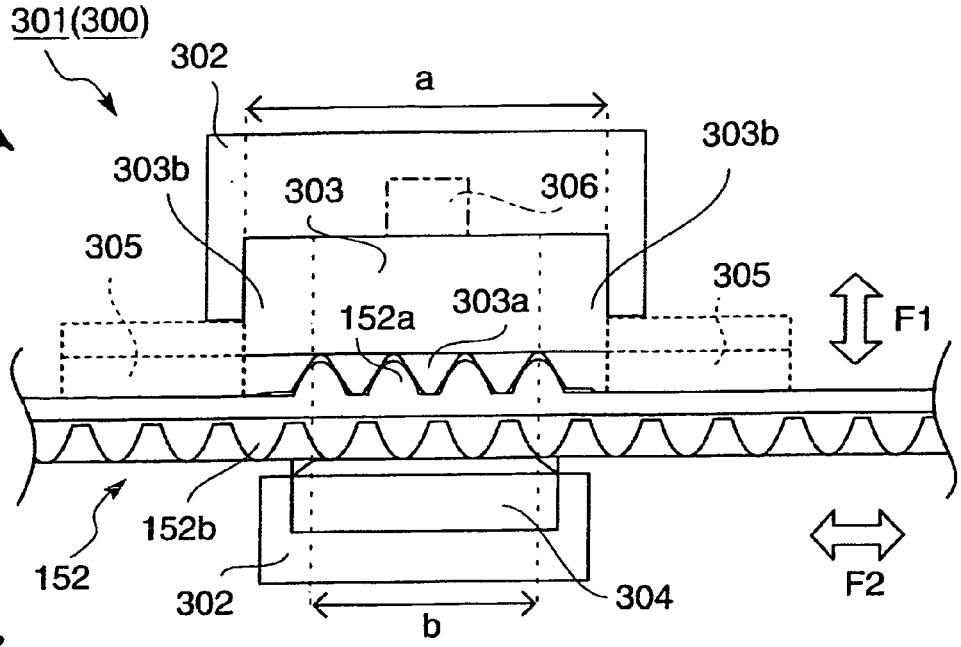
FIGS. 5A and 5B are rear views showing operation of the connector according to the invention.
Figure 5B:
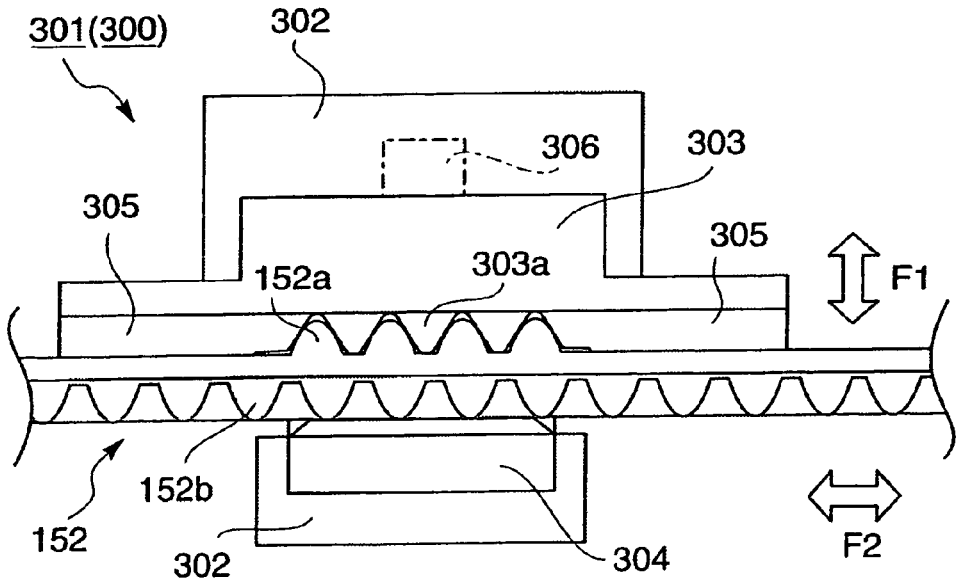

FIGS. 5A and 5B show rear views showing operation of the connector according to the invention.

As shown by FIG. 5A, the second teeth 152*a* provided at the carriage carrying belt 152 is fitted with the first teeth portion 303*a* provided at the first absorber 303 and squeezed and held by the first absorber 303 and the second absorber 304. Here, the first teeth portion 303*a* and the second teeth portion 152*a* are constituted by spur teeth, and a face of the carriage carrying belt 152 opposed to the face formed with the second teeth portion 152*a*, that is, an inner peripheral face thereof is formed with a third teeth portion 152*b*. The third teeth portion 152*b* is constituted by skew teeth and is provided to be engaged with skew teeth, not illustrated, provided at the drive pulley 150 and the driven pulley 151.

Further, as described above, the length a of the first absorber 303 is provided to be longer than the length b of the second absorber 304. Therefore, at both sides in the main scanning direction of the first absorber 303 are produced non-opposed portions 303*b* which are not opposed to the second absorber 304. First, operation and effect of the non-opposed portions 303*b* will be explained.

Here, the first absorber 303 and the second absorber 304 of the elastic member for squeezing and holding the carriage carrying belt 152 are held at inside of the holder. That is, the first absorber 303 and the second absorber 304 are pressed to be compressed in an up and down direction, that is, in a vertical direction to the carriage carrying belt face, in the drawing of FIG. 5A. Therefore, at the pressed and compressed portion, there is a concern that vibration propagated through the carriage carrying belt 152 cannot effectively be absorbed.

However, the non-opposed portion 303*b* is not opposed to the second absorber 304 and therefore, the non-opposed portion 303*b* is not pressed to be compressed by a strong force. That is, the non-opposed portion 303*b* can be brought into contact to be pressed by the carriage carrying belt 152 while maintaining a pertinent elastic force. Therefore, vibration propagated through the carriage carrying belt 152 can effectively be absorbed thereby. Specifically, there are two kinds of vibrations, that is, a transverse wave vibration F1 and a longitudinal wave vibration F2; the transverse wave vibration F1 vibrating in a direction orthogonal to a direction of moving the carriage 107, that is, the main scanning direction, and the longitudinal wave vibration F2 vibrating in the main scanning direction.

Here, although with regard to the longitudinal wave vibration F2 vibrating in a direction orthogonal to the main scanning direction, there are conceivable a direction directed from an inner peripheral face to an outer peripheral face of the carriage carrying belt 152, that is, a direction orthogonal to the face of the carriage carrying belt 152, and a direction of rotational axes of the drive pulley 150 and the driven pulley 151, that is, the sub scanning direction the former longitudinal wave vibration F2 in the direction orthogonal to a face of the carriage carrying belt 152 is considered to be the larger and have an influence on the carriage 107.

When the transverse wave vibration F1 is propagated through the carriage carrying belt 152, a thickness of the non-opposed portion 303*b* can absorb the transverse wave vibration F1 in a thickness direction (direction orthogonal to the face of the carriage carrying belt 152). Further, when the longitudinal wave vibration F2 is propagated through the carriage carrying belt 152, a length in the main scanning direction of the non-opposed portion 303*b* can absorb the longitudinal wave vibration F2 in the length direction (main scanning direction).

Next, operation and effect of the third absorber 305 will be explained.

As shown by FIG. 5B, both sides in the main scanning direction of the first absorber 303 are provided with the third absorbers 305 projecting from the holder 302 to be brought into contact with the carriage carrying belt 152 to be pressed thereby. The third absorber 305 is provided on the outer side of the holder 302 and therefore, brought into a state in which the third absorber 305 is not compressed by the holder 302 at all and is sufficiently provided with the elastic force. Therefore, when the transverse wave vibration F1 is propagated through the carriage carrying belt 152, the thickness of the third absorber 305 can absorb the transverse wave vibration F1 in the thickness direction (direction orthogonal to the face of the carriage carrying belt 152). Further, when the longitudinal wave vibration F2 is propagated through the carriage carrying belt 152, the length in the main scanning direction of the third absorber 305 can absorb the longitudinal wave vibration F2 in the length direction (main scanning direction).

Successively, a third absorber according to other embodiment will be explained.

Other Embodiment 1

FIGS. 6A, 6B, 7A and 7B show rear views showing a connector according to other embodiments of the invention.

Figure 6A:
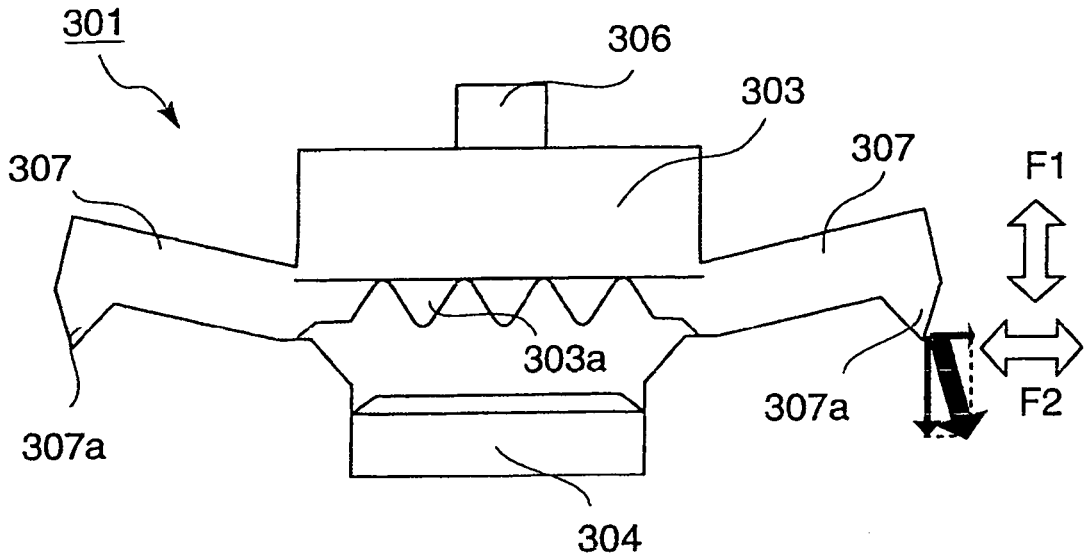
FIGS. 6A and 6B are rear views showing a connector according to other embodiment of the invention.

As shown by FIG. 6A, first contact projecting portions 307*a* are provided at positions opposed to the carriage carrying belt 152 at both ends in the main scanning direction of a third absorber 307. The first contact projecting portion 307*a* is urged to an outer side in the main scanning direction by the third absorber 307 and presses the carriage carrying belt 152. Therefore, among components of force pressing the carriage carrying belt 152 by the first contact projecting portion 307*a*, the component of force in a direction orthogonal to the face of the carriage carrying belt 152 can be canceled by a force exerted by the transverse wave vibration F1. Further, among the components of force pressing the carriage carrying belt 152 by the first contact projecting portion 307*a*, the component of force in the main scanning direction can be canceled by a force exerted by the longitudinal wave vibration F2. The constitution is effective to a longitudinal wave (pressing force) coming to the carriage 107 among the longitudinal waves.

Other Embodiment 2

Figure 6B:
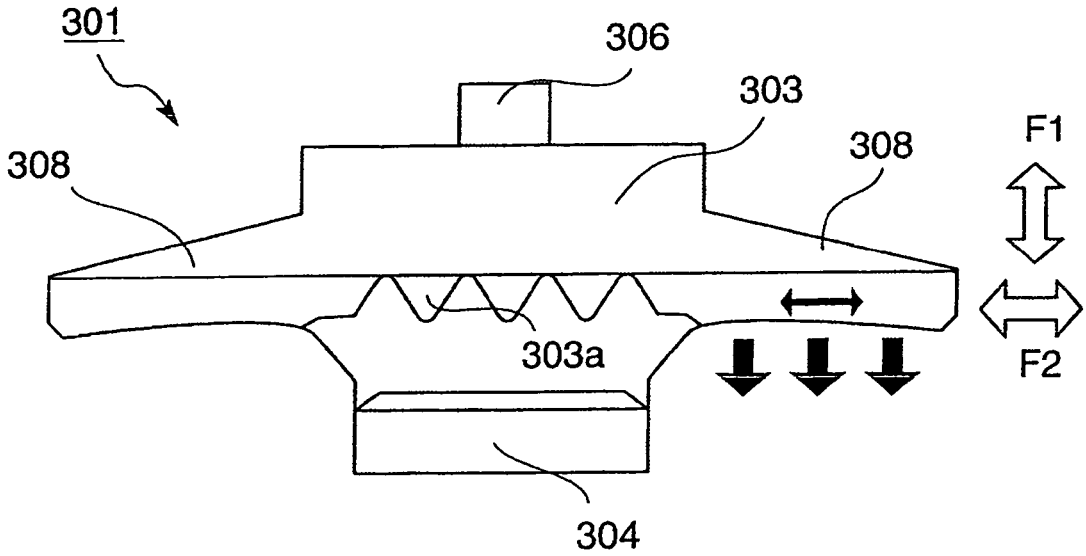

As shown by FIG. 6B, third absorbers 308 are formed thin-wall toward both ends in the main scanning direction and are provided such that a pressure applied on faces thereof brought into contact with the carriage carrying belt 152 to be pressed thereby becomes uniform. Therefore, the transverse wave vibration F1 and the longitudinal wave vibration F2 propagated through the carriage carrying belt 152 can be dispersed uniformly by the contact faces of the third absorbers 308 to be absorbed.

Other Embodiment 3

Figure 7A:
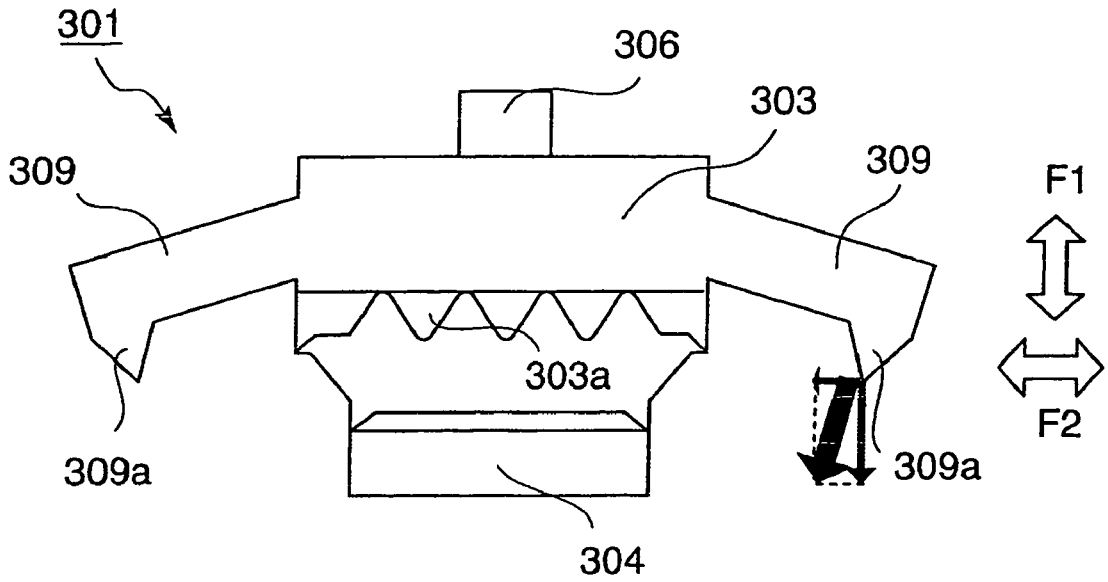
FIGS. 7A and 7B are rear views showing a connector according to other embodiment of the invention.

As shown by FIG. 7A, second contact projecting portions 309*a* are provided at positions opposed to the carriage carrying belt 152 at both ends in the main scanning direction of third absorbers 309. The second contact projecting portion 309*a* is urged to an inner side in the main scanning direction by the third absorber 309 and presses the carriage carrying belt 152. Therefore, among components of force pressing the carriage carrying belt 152 by the second contact projecting portion 309*a*, the component of force in the direction orthogonal to the face of the carriage carrying belt 152 can be canceled by the force exerted by the transverse wave vibration F1. Further, among the components of force of pressing the carriage carrying belt 152 by the second contact projecting portion 309*a*, the component of force in the main scanning direction can be canceled by the force exerted by the longitudinal wave vibration F2. The constitution is effective to a longitudinal wave (pulling force) going away from the carriage 107 among the longitudinal waves.

Other Embodiment 4

Figure 7B:
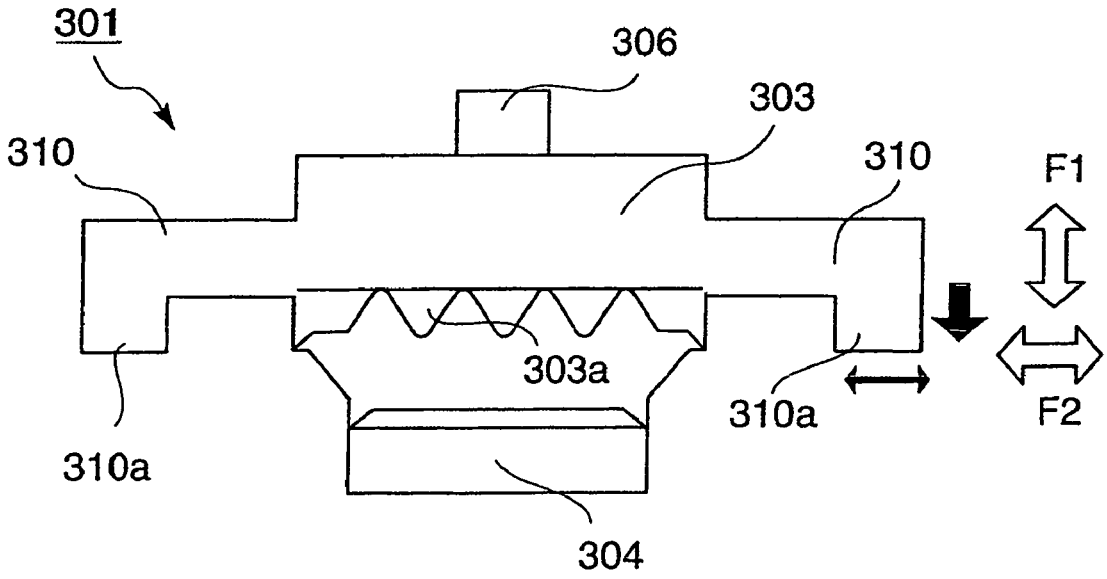

As shown by FIG. 7B, third contact projecting portions 310*a* are provided at positions opposed to the carriage carrying belt 152 at both ends in the main scanning direction of third absorbers 310. The third contact projecting portion 310*a* is pressed in a direction orthogonal to the face of the carriage carrying belt 152 by the third absorber 310. Therefore, a pressing force in the direction orthogonal to the face of the carriage carrying belt 152 can be canceled by the force exerted by the transverse wave vibration F1. Further, the third contact projecting portion 310*a* is provided to be remote from the first absorber 303 and can be brought into face contact with the carriage carrying belt 152 and therefore, the third contact projecting portion 310*a* can further effectively follow the longitudinal wave vibration F2. That is, the longitudinal wave vibration F2 can be absorbed by the third contact projecting portion 310*a* and third absorber 310. The constitution is effective to both of the longitudinal wave (pressing force) coming to the carriage 107 and the longitudinal wave (pulling force) going away from the carriage 107 among the longitudinal waves.

The connection unit 300 of connecting and holding the carriage carrying belt 152 and the carriage 107 according to the embodiment is the connection unit 300 of connecting and holding the carriage carrying belt 152 in the shape of the endless strip wound between the drive pulley 150 and the driven pulley 151 and the carriage 107 reciprocated in the main scanning direction in the state of mounting the recording head 106, which includes the first absorber 303 constituting the connector 301 and the second absorber 304 for squeezing the carriage carrying belt 152 in cooperation with the first absorber 303 at inside of the holder of holding the connector 301 which is the elastic member and in which the first absorber 303 is provided to be longer than the second absorber 304 in the main scanning direction.

As a result, the first absorber 303 includes the non-opposed portion 303*b* as the portion extruded from the position opposed to the second absorber 304. The non-opposed portion 303*b* does not squeeze the carriage carrying belt 152 in cooperation with the second absorber 304. That is, the non-opposed portion 303*b* is brought into a state in which the non-opposed portion 303*b* is not compressed and is sufficiently provided with the elastic force. Therefore, the non-opposed portion 303*b* is brought into contact with the carriage carrying belt 152 and therefore, can absorb the transverse wave vibration F1 and the longitudinal wave vibration F2 of the carriage carrying belt 152 and can excellently execute recording on the sheet.

The first absorber 303 and the second absorber 304 according to the embodiment therein are arranged to be aligned to centers in the main scanning direction.

As a result, the first absorbers 303 include the non-opposed portions 303*b* on both sides of the first absorber 303. That is, the non-opposed portion 303*b* can absorb the transverse wave vibration F1 and the longitudinal wave vibration F2, to whichever side in the main scanning direction the carriage 107 may move.

Further, the second absorber 304 according to the embodiment is provided on the inner side of the wound carriage carrying belt 152. That is, the second absorber 304 which is shorter than the first absorber 303 in the main scanning direction is arranged on an inner periphery of the carriage carrying belt 152.

As a result, there is not a concern of being brought into contact with the drive pulley 150 and the driven pulley 151 by an amount of being short in the main scanning direction. That is, a main scanning distance of the carriage 107 can be set to be longer by the amount of being short in the main scanning direction.

According to the embodiment, there is provided the third absorber 305 (307 through 310) which is integrally formed with the first absorber 303, projected from the holder 302 in the main scanning direction and brought into contact with the carriage carrying belt 152. That is, the third absorber 305 (307 through 310) is projected from the holder 302 and therefore, the third absorber 305 is brought into the state in which the third absorber 305 is not compressed and sufficiently provided with the elastic force.

As a result, the third absorber 305 (307 through 310) is brought into contact with the carriage carrying belt 152 and therefore, can further effectively absorb the transverse wave vibration F1 and the longitudinal wave vibration F2 of the belt.

Further, the third absorber 305 (307 through 310) can exert the force to the carriage carrying belt 152 from the holder 302 to push or pull the carriage carrying belt 152 in the main scanning direction. The former force can be canceled by the longitudinal wave pushing the carriage 107 (approaching wave) at the position of the belt brought into contact with the third absorber 305 (307 through 310). On the other hand, the latter force can be canceled by the longitudinal wave of pulling the carriage 107 (leaving wave).

Further, according to the embodiment, the first absorber 303 and the second absorber 304 are integrally formed in the horseshoe shape in the side view in the main scanning direction.

As a result, a simple structure can be constituted by reducing a number of pieces of parts.

Further, the connector 301 of the embodiment is provided with the drawout stopping projection 306 engageable with the holder 302.

As a result, a positional shift of the connector 301 relative to the holder 302 can be prevented.

Further, naturally, hardnesses of the elastic members of the first absorber, the second absorber, and the third absorber can pertinently be changed to set in accordance with a magnitude of the vibration and may be hardnesses respectively different from each other. Naturally, a frequency and an amplitude generated in the vibration are changed according to a tension of the carriage carrying belt, a torque of the carriage motor or the like and hardnesses, sizes and shapes of the absorbers are changed to set in accordance therewith. Further, although in the above-described explanation, an explanation has been given by taking the example of vibration, naturally impact in accordance with a rapid change in a speed of the carriage motor can be absorbed.

Further, there is conceivable a transverse wave vibration in the sub scanning direction, that is, a transverse wave vibration in a width direction of the carriage carrying belt. In order to absorb the vibration, naturally, an absorber can be provided to be brought into contact with any portion in the width direction of the carriage carrying belt similarly to the third absorber.

Further, it is needless to say that the invention is not limited to the above-described embodiments but can variously be modified within the range of the invention described in the scope of claims and the modifications can also be included in the range of the invention.

What is claimed is:

1. A connection unit for connecting and holding an endless belt which is wound between a drive pulley and a driven pulley, and a carriage on which a recording head is mounted and which is reciprocated in a main scanning direction, the connection unit comprising:

a holder, formed on the carriage; and an elastic connector, operable to be connected to the belt, the connector comprising a first absorber and a second absorber that hold the belt therebetween, wherein the first absorber is longer than the second absorber in the main scanning direction, and the holder holds the first absorber and the second absorber in a direction perpendicular to the main scanning direction without being in contact with end portions of the first absorber in the main scanning direction, wherein the first absorber and the second absorber are pressed to be compressed in the direction perpendicular to the main scanning direction inside of the holder.

2. The connection unit according to claim 1, wherein a center portion of the first absorber corresponds to a center portion of the second absorber in the main scanning direction.

3. The connection unit according to claim 1, wherein the second absorber abuts against an inner surface of the belt.

4. The connection unit according to claim 1, wherein the connector further comprises a third absorber, integrally formed with the first absorber, projected from the holder in the main scanning direction, and abutting against the belt.

5. The connection unit according to claim 1, wherein the first absorber and the second absorber are integrally formed in a horseshoe shape in the main scanning direction.

6. The connection unit according to claim 1, wherein the connector includes a projection being engageable with the holder.

7. A recording apparatus comprising:

an endless belt, wound between a drive pulley and a driven pulley;

a carriage, operable to be reciprocated in a main scanning direction;

a recording head, mounted on the carriage, and operable to record information on a medium; and a connection unit for connecting and holding the belt and the carriage, the connection unit comprising:

a holder, formed on the carriage; and an elastic connector, operable to be connected to the belt, the connector comprising a first absorber and a second absorber that hold the belt therebetween, wherein the first absorber is longer than the second absorber in the main scanning direction, and the holder holds the first absorber and the second absorber in a direction perpendicular to the main scanning direction without being in contact with end portions of the first absorber in the main scanning direction, wherein the first absorber and the second absorber are pressed to be compressed in the direction perpendicular to the main scanning direction inside of the holder.

8. A liquid ejecting apparatus comprising:

an endless belt, wound between a drive pulley and a driven pulley;

a carriage, operable to be reciprocated in a main scanning direction;

a recording head, mounted on the carriage, which ejects liquid toward a medium; and a connection unit for connecting and holding the belt and the carriage, the connection unit comprising:

a holder, formed on the carriage; and an elastic connector, operable to be connected to the belt, the connector comprising a first absorber and a second absorber that hold the belt therebetween, wherein the first absorber is longer than the second absorber in the main scanning direction, and the holder holds the first absorber and the second absorber in a direction perpendicular to the main scanning direction without being in contact with end portions of the first absorber in the main scanning directions wherein the first absorber and the second absorber are pressed to be compressed in the direction perpendicular to the main scanning direction inside of the holder.

* * * * *

UNITED STATES PATENT AND TRADEMARK OFFICE

CERTIFICATE OF CORRECTION

PATENT NO. : 7,611,224 B2
APPLICATION NO. : 11/393280
DATED : November 3, 2009
INVENTOR(S) : Kazuhiko Tsuyama It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 630 days.

Signed and Sealed this

Twelfth Day of October, 2010

David J. Kappos

David J. Kappos
*Director of the United States Patent and Trademark Office*